US008245602B2

(12) United States Patent
Chan

(10) Patent No.: US 8,245,602 B2
(45) Date of Patent: Aug. 21, 2012

(54) RATCHET WRENCH

(76) Inventor: Meng Tsung Chan, Changhua (TW)

( * ) Notice: Subject to any disclaimer, the term of this patent is extended or adjusted under 35 U.S.C. 154(b) by 290 days.

(21) Appl. No.: 12/655,740

(22) Filed: Jan. 7, 2010

(65) Prior Publication Data

US 2011/0162488 A1 Jul. 7, 2011

(51) Int. Cl.
*B25B 13/46* (2006.01)

(52) U.S. Cl. ..... 81/63; 81/60; 81/61; 81/62; 81/63.1; 81/63.2

(58) Field of Classification Search ..... 81/60, 61, 81/62, 63, 63.1, 63.2
See application file for complete search history.

(56) References Cited

U.S. PATENT DOCUMENTS 4,520,697 A 6/1985 Moetteli
4,553,453 A 11/1985 Dempsey et al.
5,255,576 A 10/1993 Keith
5,878,635 A 3/1999 Hsieh
6,131,489 A 10/2000 Yang
6,155,140 A 12/2000 Tsai
6,161,454 A * 12/2000 Chaconas ..... 81/63.2
6,295,899 B1 10/2001 Lee
7,237,460 B2 * 7/2007 Hu ..... 81/63.2
7,861,620 B2 * 1/2011 Arnold et al. ..... 81/63.2

* cited by examiner

*Primary Examiner* — Lee D Wilson
*Assistant Examiner* — Shantese McDonald
(74) *Attorney, Agent, or Firm* — Charles E. Baxley

(57) ABSTRACT

A ratchet wrench includes a wrench head having a pawl compartment formed between a notch and a chamber of the wrench head, a drive member mounted in the chamber of the wrench head and having a ratchet gear, a pawl slidably received in the pawl compartment of the wrench head for engaging with the ratchet gear and for controlling the driving direction of the drive member by the wrench head, a handle having a pivotal coupling member mounted in the notch of the wrench head, and an actuating member attached to the pivotal coupling member and engaged with the pawl for moving the pawl to either side of the pawl compartment of the wrench head in order to determine the driving direction of the drive member by the wrench head.

8 Claims, 3 Drawing Sheets

RATCHET WRENCH

BACKGROUND OF THE INVENTION

1. Field of the Invention

The present invention relates to a ratchet wrench, and more particularly to a ratchet wrench including an improved and simplified structure for being easily and quickly manufactured and assembled and for being easily operated or actuated by the user without an actuating knob or switch.

2. Description of the Prior Art

Typical ratchet wrenches comprise a head with an aperture there-through having ratchet teeth thereon, a drive member mounted for rotation relative to the head and defines a slide surface facing the ratchet teeth on the head, a pawl positioned between the slide surface and the head with the pawl having two sets of ratchet teeth for determining the driving direction of the drive member by the head.

For example, U.S. Pat. No. 4,520,697 to Moetteli discloses one of the typical ratchet wrenches also comprising a drive member mounted in the aperture of the head for rotation relative to the head, a pawl also mounted in the head and positioned for engaging with the ratchet teeth of the drive member in order to determine the driving direction of the drive member by the head, and two pins attached to a rotatable plate for actuating the pawl to control the driving direction of the drive member by the head.

However, the two pins are required to be extended out of the head and/or the drive member for being actuated or operated by the user and for controlling the driving direction of the drive member by the head.

U.S. Pat. No. 4,553,453 to Dempsey et al. discloses another typical ratchet wrench comprising a quick release mechanism, a continuous, uninterrupted friction wheel assembly mounted in the cavity of the wrench head for rotation relative to the wrench head, and a thumb actuated reverse mechanism provided for controlling the driving direction of the friction wheel assembly by the wrench head.

However, the thumb actuated reverse mechanism also includes a plunger that is required to be extended out of the friction wheel assembly and/or the wrench head for being actuated or operated by the user and for controlling the driving direction of the friction wheel assembly by the wrench head.

U.S. Pat. No. 5,255,576 to Keith discloses a further typical ratchet wrench comprising a ratcheting mechanism and a multi-configurated socket with adjustment bolt for opening and closing fire hydrant valves and removal and replacement of hydrant caps of various shapes and sizes, a pawl mounted in the ratcheting handle for determining the driving direction of the ratcheting gear by the ratcheting handle, and a pawl actuating lever is required to be coupled to the pawl for controlling the driving direction of the ratcheting gear by the ratcheting handle.

However, the pawl and/or the pawl actuating lever are required to be extended out of the ratcheting gear and/or the ratcheting handle for being actuated or operated by the user and for controlling or determining the driving direction of the ratcheting gear by the ratcheting handle.

U.S. Pat. No. 5,878,635 to Hsieh discloses a still further typical reversible ratchet wrench comprising an annular wheel mounted in a box end, and two pairs of stop plates mounted in the box end and biased to control or determine the driving direction of the annular wheel by the box end of a wrench handle.

However, the typical reversible ratchet wrench includes a one-way ratchet mechanism that may not be easily controlled or changed to the reverse drive direction.

U.S. Pat. No. 6,131,489 to Yang discloses a still further typical reversible ratchet wrench comprising an adapter mounted in a box body, and a driving block also mounted in the box body and selectively actuatable to engage with the adapter in order to determine or to control the driving direction of the adapter by the box body.

However, the driving block is required to be extended out of the box body for being actuated or operated by the user and for controlling or determining the driving direction of the adapter by the box body.

U.S. Pat. No. 6,155,140 to Tsai discloses a still further typical reversible ratchet wrench comprising a gear mounted in a notch of a head, and two pawls also mounted in the head for engaging with gear and for controlling or determining the driving direction of the gear by the head of the handle.

However, the gear may only be rotated or driven in one direction or unidirectionally, and the head of the handle should be disposed up-side-down for allowing the gear to be rotated or driven in the other direction by the head.

U.S. Pat. No. 6,295,899 to Lee discloses a still further typical reversible ratchet wrench comprising a barrel mounted in an opening of a head, and a number of drive inserts slidably engaged into the barrel and engageable with the curved and inclined or helical surfaces of the head, and a ring attached or mounted to the barrel for rotating the barrel and the drive inserts relative to the head and the fastener to be rotated or driven by the head of the wrench handle.

However, the barrel and/or the drive inserts are also required to be operated or actuated by the user in order to determine or to control the driving direction of the barrel and the fastener by the head of the wrench handle.

The present invention has arisen to mitigate and/or obviate the afore-described disadvantages of the conventional reversible ratchet wrenches.

SUMMARY OF THE INVENTION

The primary objective of the present invention is to provide a ratchet wrench including an improved and simplified structure for being easily and quickly manufactured and assembled and for being easily operated or actuated by the user without an actuating knob or switching device.

In accordance with one aspect of the invention, there is provided a ratchet wrench comprising a wrench head including a chamber formed therein, and including a notch formed therein and spaced from the chamber of the wrench head and having an opening communicative with the notch of the wrench head, and including a pawl compartment formed therein and located between and communicative with the notch and the chamber of the wrench head and having a first side and a second side, a drive member mounted in the chamber of the wrench head for rotation relative to the wrench head, and including a ratchet gear provided on an outer peripheral portion thereof, a pawl slidably received in the pawl compartment of the wrench head and movable between either the first side or the second side of the pawl compartment of the wrench head for selectively engaging with the ratchet gear of the drive member, and the pawl being engageable between the drive member and either the first side or the second side of the pawl compartment of the wrench head for determining and controlling a driving direction of the drive member by the wrench head, a handle including a pivotal coupling member pivotally mounted in the notch of the wrench head, and an actuating member attached to the pivotal coupling member of the handle and engaged with the pawl for forcing and moving the pawl to either the first side or the second side of the pawl compartment of the wrench head in order to determine and control the driving direction of the drive member by the wrench head.

The handle includes a cavity formed in the pivotal coupling member for receiving and engaging with the actuating member. The pawl includes a depression formed therein for receiving and engaging with the actuating member. The handle includes a narrowed neck portion formed and located beside the pivotal coupling member.

The handle includes a spring biased projection engageable with the wrench head in order to anchor and position the pivotal coupling member of the handle to the wrench head at selected positions. The wrench head includes two depressions formed therein and communicative with the notch of the wrench head for selectively engaging with the spring biased projection of the handle.

The wrench head includes a cover attached thereto with a retaining ring for retaining the pivotal coupling member of the handle to the wrench head. The pawl includes a toothed side for selectively engaging with the ratchet gear of the drive member. The opening of the wrench head includes a sector shape.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
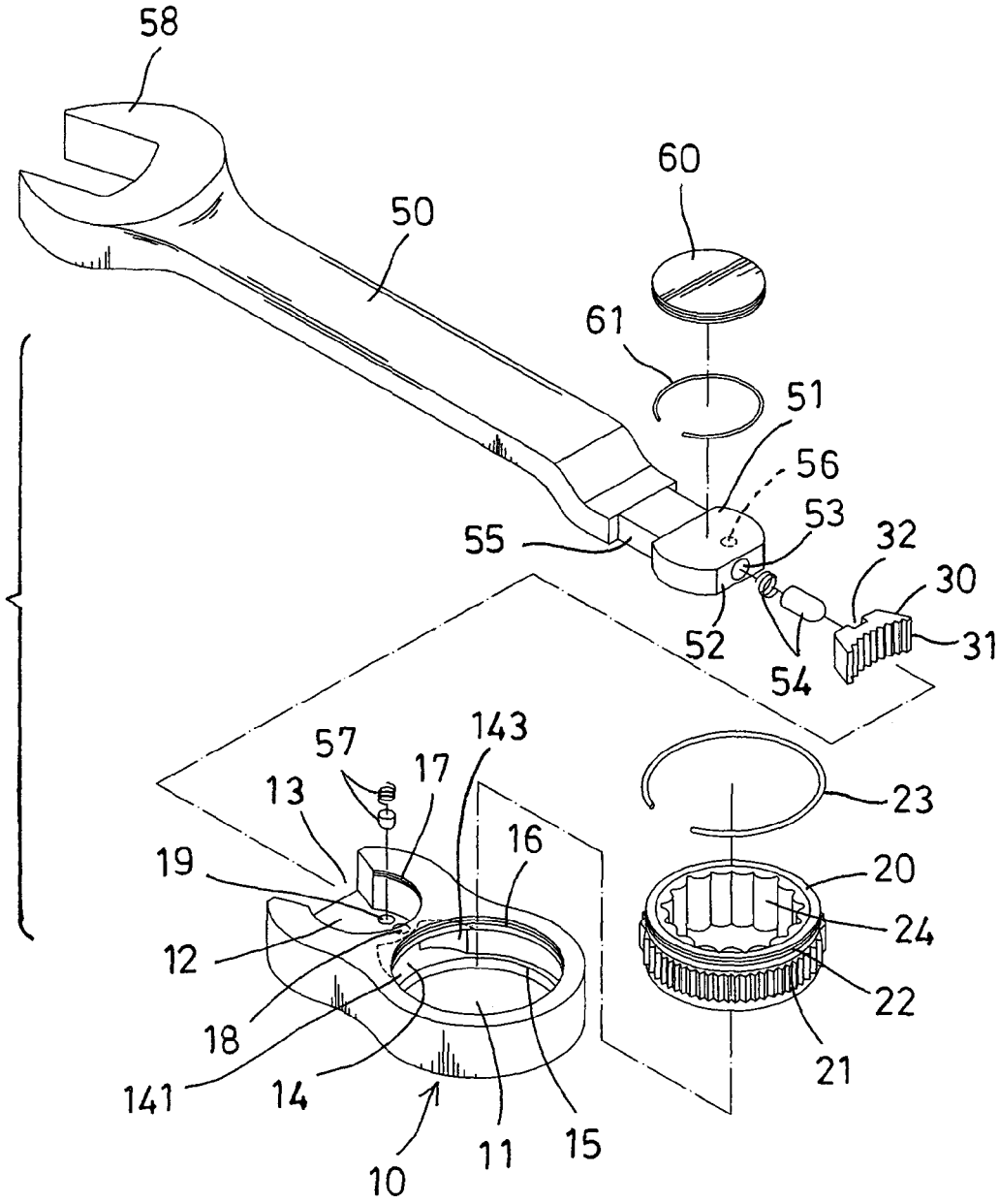
FIG. 1 is a partial exploded view of a ratchet wrench in accordance with the present invention.
Figure 2:
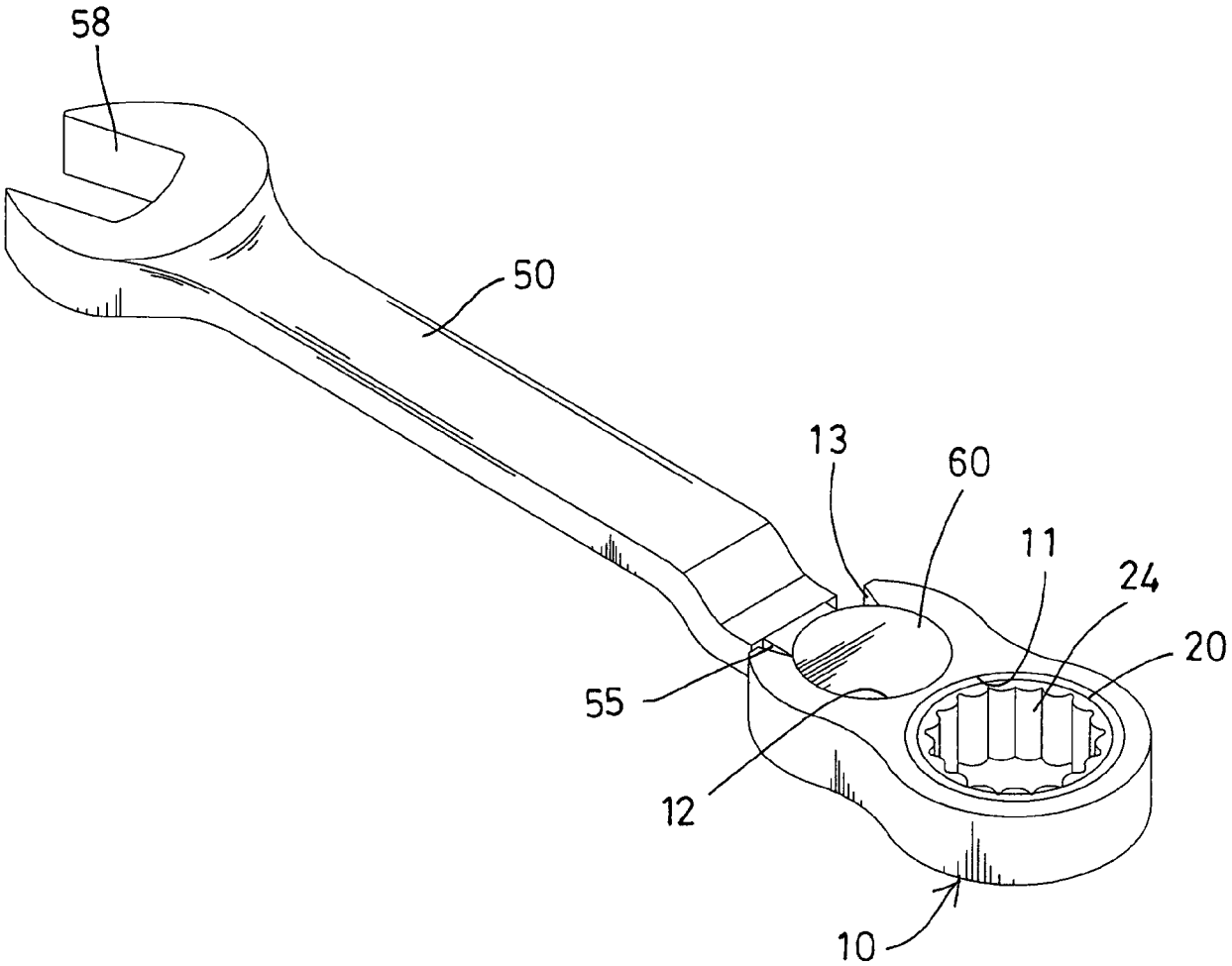
FIG. 2 is a perspective view of the ratchet wrench.
Figure 3:
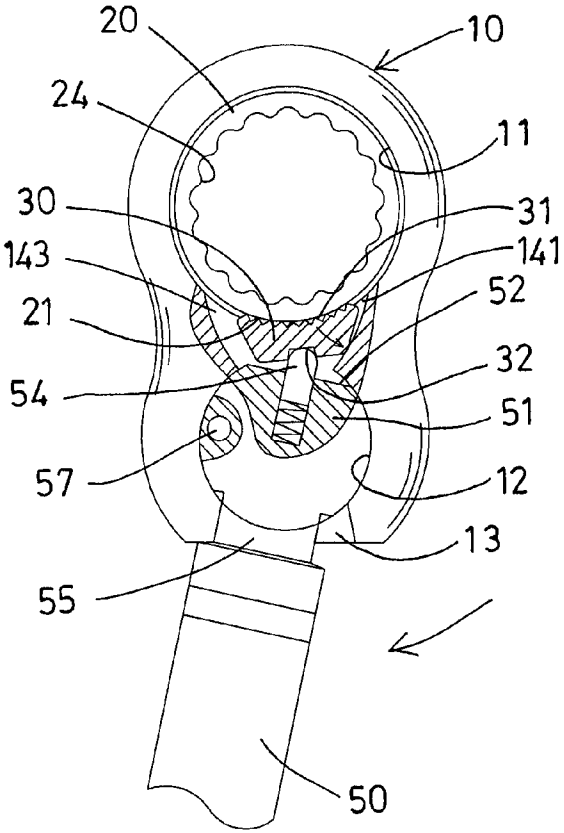
FIG. 3 is a partial plan schematic view and partial cross sectional view of the ratchet wrench.

Referring to the drawings, and initially to FIGS. 1-3, a ratchet wrench in accordance with the present invention comprises a box end or wrench head 10 including a chamber 11, such as a circular or cylindrical chamber 11 formed therein, and including a notch 12 formed therein and spaced or disengaged from the chamber 11 of the wrench head 10 and having a sector-shaped opening 13 communicative with the notch 12 of the wrench head 10, and including a passage or pawl compartment 14 formed therein and located between the notch 12 and the chamber 11 of the wrench head 10 and communicative with the notch 12 and the chamber 11 of the wrench head 10, in which the notch 12 of the wrench head 10 includes a radian or arc having more than 180 degrees or more than one half of a circle.

The wrench head 10 includes a peripheral shoulder 15 formed in the upper or lower portion of the wrench head 10 and communicative with the chamber 11 of the wrench head 10, and includes a peripheral groove 16 formed in the lower or upper portion of the wrench head 10 and communicative with the chamber 11 of the wrench head 10, and includes a peripheral slot 17 formed in the lower or upper portion of the wrench head 10 and communicative with the notch 12 and/or the opening 13 of the wrench head 10, and includes one or more (such as two) depressions 18, 19 formed in the upper or lower portion of the wrench head 10 and communicative with the notch 12 of the wrench head 10.

A drive member 20 is mounted in the chamber 11 of the wrench head 10 for rotation relative to the wrench head 10, and includes a ratchet gear wheel or a number of ratchet teeth 21 extended or formed or provided on the outer peripheral portion thereof and engaged with the peripheral shoulder 15 of the wrench head 10 for anchoring or positioning or retaining the drive member 20 in the chamber 11 of the wrench head 10, and includes a peripheral slot 22 formed in the lower or upper portion of the drive member 20 for engaging with a clamping or retaining ring 23 which is engaged with the peripheral groove 16 of the wrench head 10 for solidly and pivotally or rotatably coupling the drive member 20 to the wrench head 10 and for preventing the drive member 20 from being disengaged from the wrench head 10.

The drive member 20 includes an engaging or driving portion or element 24, such as a driving shank or stem extended therefrom, an engaging opening 24 formed therein, or the like for engaging with the fastener (not shown) to be rotated or driven by the wrench head 10. A portion of the retaining ring 23 is located at or facing toward and reachable through the pawl compartment 14 of the wrench head 10. A pawl 30 is slidably or movably received or engaged in the pawl compartment 14 of the wrench head 10, and includes a toothed surface or end or side 31 for selectively engaging with the ratchet gear 21 of the drive member 20 (FIGS. 3, 4) and for determining or controlling the driving direction of the drive member 20 by the wrench head 10.

Figure 4:
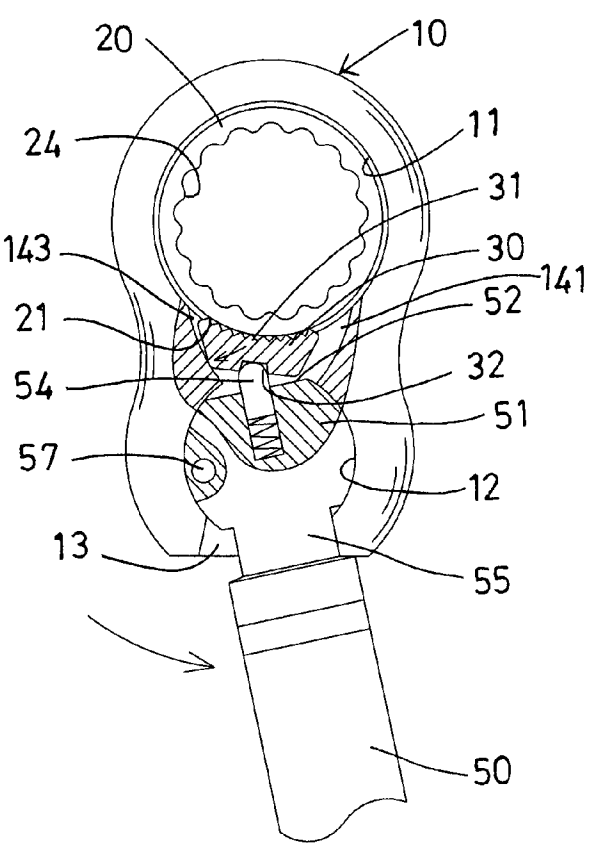
FIG. 4 is another partial plan schematic view and partial cross sectional view similar to FIG. 3, illustrating the operation of the ratchet wrench.

For example, as shown in FIG. 3, when the pawl 30 is engaged in one or first side 141, such as the right side 141 of the pawl compartment 14 of the wrench head 10 and when the wrench head 10 is rotated or driven clockwise, the pawl 30 may be forced to be solidly engaged between the drive member 20 and the right side 141 of the pawl compartment 14 of the wrench head 10 for allowing the drive member 20 to be rotated or driven clockwise by the wrench head 10. On the contrary, as shown in FIG. 4, when the pawl 30 is engaged in the other or second side 143, such as the left side 143 of the pawl compartment 14 of the wrench head 10 and when the wrench head 10 is rotated or driven counter-clockwise, the pawl 30 may be forced to be solidly engaged between the drive member 20 and the left side 143 of the pawl compartment 14 of the wrench head 10 for allowing the drive member 20 to be rotated or driven counter-clockwise by the wrench head 10.

The above-described structure including the rotating engagement of the drive member 20 within the chamber 11 of the wrench head 10 and the engagement of the pawl 30 with the drive member 20 is typical and has been shown in the cited arts, and will not be described in further details. The ratchet wrench in accordance with the present invention further comprises a handle 50 including a pivotal coupling end or member 51 having a similar circular or cylindrical shape or size or dimension corresponding to that of the notch 12 of the wrench head 10 for pivotally or rotatably attaching or mounting or coupling the handle 50 to the wrench head 10 and for allowing the handle 50 to be slightly pivoted or rotated relative to the wrench head 10.

The pivotal coupling member 51 of the handle 50 includes a first or inner side or end 52 located at or facing toward the pawl compartment 14 of the wrench head 10, and includes a cavity 53 formed in the inner end 52 of the pivotal coupling member 51 for receiving or attaching or engaging with a spring biased projection or actuating member 54 which is engaged with a depression 32 that is formed in the other side opposite to the toothed side 31 of the pawl 30, and for forcing or moving the pawl 30 to either side of the pawl compartment 14 of the wrench head 10 (FIGS. 3, 4) and thus for determining or controlling the driving direction of the drive member 20 by the wrench head 10 in either the clockwise direction or the counter-clockwise direction.

A cover 60 may further be provided and attached or secured to the wrench head 10 with a clamping or retaining ring 61 which is engaged with the peripheral slot 17 of the wrench head 10 for solidly and pivotally or rotatably coupling the cover 60 to the wrench head 10 and for preventing the cover 60 from being disengaged from the wrench head 10, the cover 60 may be engaged with the pivotal coupling member 51 of the handle 50 for solidly and stably attaching or mounting and retaining the pivotal coupling member 51 of the handle 50 to the wrench head 10 and for preventing the pivotal coupling member 51 of the handle 50 from being disengaged from the wrench head 10.

It is preferable that the handle 50 includes a narrowed neck portion 55 formed therein, such as formed or located between the pivotal coupling member 51 and the handle 50 or located close to or beside the pivotal coupling member 51 for allowing the pivotal coupling member 51 of the handle 50 to be suitably pivoted or rotated relative to the wrench head 10 and for limiting the pivotal coupling member 51 of the handle 50 to pivot or rotate relative to the wrench head 10 within a limited rotating angle. The handle 50 may further include a blind hole or orifice 56 formed therein and facing downwardly or toward the depressions 18, 19 of the wrench head 10 for receiving or engaging with another spring biased projection 57 which is engageable with either of the depressions 18, 19 of the wrench head 10 in order to anchor or position the pivotal coupling member 51 of the handle 50 to the wrench head 10 at selected or predetermined positions or locations.

For example, as shown in FIG. 3, when the pivotal coupling member 51 of the handle 50 is pivoted or rotated clockwise relative to the wrench head 10, the spring biased projection 57 may be engaged with the inner depression 18 of the wrench head 10 that is located closer to the pawl compartment 14 of the wrench head 10 and the drive member 20 in order to suitably position the pawl 30 in one side 141 or right side 141 of the pawl compartment 14 of the wrench head 10. On the contrary, as shown in FIG. 4, when the pivotal coupling member 51 of the handle 50 is pivoted or rotated counter-clockwise relative to the wrench head 10, the spring biased projection 57 may be engaged with the other or outer depression 19 of the wrench head 10 that is located distal to the pawl compartment 14 of the wrench head 10 and the drive member 20 in order to suitably position the pawl 30 in the other side 143 or left side 143 of the pawl compartment 14 of the wrench head 10.

In operation, when the pivotal coupling member 51 of the handle 50 is pivoted or rotated clockwise relative to the wrench head 10 as shown in FIG. 3, the pawl 30 may be forced to be solidly engaged between the drive member 20 and the right side 141 of the pawl compartment 14 of the wrench head 10 for allowing the drive member 20 to be rotated or driven clockwise by the wrench head 10 and for allowing the drive member 20 to be freely rotated counter-clockwise relative to the wrench head 10 at this moment. On the contrary, when the pivotal coupling member 51 of the handle 50 is pivoted or rotated counter-clockwise relative to the wrench head 10 as shown in FIG. 4, the pawl 30 may be forced to be solidly engaged between the drive member 20 and the left side 143 of the pawl compartment 14 of the wrench head 10 for allowing the drive member 20 to be rotated or driven counter-clockwise by the wrench head 10 and for allowing the drive member 20 to be freely rotated clockwise relative to the wrench head 10 at this moment.

It is to be noted that the pawl 30 may be forced to be moved and solidly engaged between the drive member 20 and either of the sides of the pawl compartment 14 of the wrench head 10 directly by or with the handle 50, without an additional actuating knob or switching device, such that the construction or the structure of the ratchet wrench may be suitably improved and simplified and may be easily and quickly manufactured and assembled by the workers or manufacturers and thus may be easily operated or actuated by the user. The actuating member 54 is directly attached to the pivotal coupling member 51 of the handle 50 that is pivotable or rotatable relative to the wrench head 10, and engaged with the pawl 30 for forcing or moving the pawl 30 to either side of the pawl compartment 14 of the wrench head 10. The handle 50 may include an engaging element 58 formed or provided on the other end thereof for engaging with and for driving or rotating the fasteners or the other tool members (not shown).

Accordingly, the ratchet wrench in accordance with the present invention includes an improved and simplified structure for being easily and quickly manufactured and assembled and for being easily operated or actuated by the user without an actuating knob or switching device.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ratchet wrench comprising:

a wrench head including a chamber formed therein, and including a notch formed therein and spaced from said chamber of said wrench head and having an opening communicative with said notch of said wrench head, and including a pawl compartment formed therein and located between and communicative with said notch and said chamber of said wrench head and having a first side and a second side, a drive member mounted in said chamber of said wrench head for rotation relative to said wrench head, and including a ratchet gear provided on an outer peripheral portion thereof, a pawl slidably received in said pawl compartment of said wrench head and movable between either said first side or said second side of said pawl compartment of said wrench head for selectively engaging with said ratchet gear of said drive member, and said pawl being engageable between said drive member and either said first side or said second side of said pawl compartment of said wrench head for determining and controlling a driving direction of said drive member by said wrench head, a handle including a pivotal coupling member pivotally mounted in said notch of said wrench head, a cover attached to said wrench head with a retaining ring for retaining said pivotal coupling member of said handle to said wrench head, and an actuating member attached to said pivotal coupling member of said handle and engaged with said pawl for forcing and moving said pawl to either said first side or said second side of said pawl compartment of said wrench head in order to determine and control the driving direction of said drive member by said wrench head.

2. The ratchet wrench as claimed in claim 1, wherein said handle includes a cavity formed in said pivotal coupling member for receiving and engaging with said actuating member.

3. The ratchet wrench as claimed in claim 1, wherein said pawl includes a depression formed therein for receiving and engaging with said actuating member.

4. The ratchet wrench as claimed in claim 1, wherein said handle includes a narrowed neck portion formed and located beside said pivotal coupling member.

5. The ratchet wrench as claimed in claim 1, wherein said pawl includes a toothed side for selectively engaging with said ratchet gear of said drive member.

6. The ratchet wrench as claimed in claim 1, wherein said opening of said wrench head includes a sector shape.

7. A ratchet wrench comprising:

a wrench head including a chamber formed therein, and including a notch formed therein and spaced from said chamber of said wrench head and having an opening communicative with said notch of said wrench head, and including a pawl compartment formed therein and located between and communicative with said notch and said chamber of said wrench head and having a first side and a second side, a drive member mounted in said chamber of said wrench head for rotation relative to said wrench head, and including a ratchet gear provided on an outer peripheral portion thereof, a pawl slidably received in said pawl compartment of said wrench head and movable between either said first side or said second side of said pawl compartment of said wrench head for selectively engaging with said ratchet gear of said drive member, and said pawl being engageable between said drive member and either said first side or said second side of said pawl compartment of said wrench head for determining and controlling a driving direction of said drive member by said wrench head, a handle including a pivotal coupling member pivotally mounted in said notch of said wrench head, said handle including a spring biased projection engageable with said wrench head in order to anchor and position said pivotal coupling member of said handle to said wrench head at selected positions, and an actuating member attached to said pivotal coupling member of said handle and engaged with said pawl for forcing and moving said pawl to either said first side or said second side of said pawl compartment of said wrench head in order to determine and control the driving direction of said drive member by said wrench head.

8. The ratchet wrench as claimed in claim 7, wherein said wrench head includes two depressions formed therein and communicative with the notch of the wrench head for selectively engaging with said spring biased projection of said handle.

* * * * *